United States Patent [19]

Messenger et al.

[11] Patent Number: 4,692,271

[45] Date of Patent: Sep. 8, 1987

[54] CONCENTRATED AQUEOUS SURFACTANT COMPOSITIONS

[75] Inventors: Edward T. Messenger, Workington; Douglas E. Mather; Brinley M. Phillips, both of Whitehaven, all of United Kingdom

[73] Assignee: Albright & Wilson Ltd., Oldbury, Warley, England

[21] Appl. No.: 171,998

[22] Filed: Jul. 24, 1980

Related U.S. Application Data

[63] Continuation of Ser. No. 967,576, Dec. 8, 1978, abandoned.

[30] Foreign Application Priority Data

Dec. 9, 1977 [GB] United Kingdom ..... 51293/77

[51] Int. Cl.[4] ..... B01F 17/02; B01F 17/10; B01F 17/12

[52] U.S. Cl. ..... 252/354; 252/353; 252/355; 252/551; 252/DIG. 14

[58] Field of Search ..... 252/353, 354, 355, 551, 252/DIG. 14

[56] References Cited

U.S. PATENT DOCUMENTS

| | | | |
|---|---|---|---|
| 3,231,504 | 1/1966 | Marion et al. | 252/558 X |
| 3,506,588 | 4/1970 | Selz | 252/355 |
| 3,513,099 | 5/1970 | Hans et al. | 252/551 X |
| 3,707,511 | 12/1972 | Lamberti et al. | 252/550 X |
| 4,072,632 | 2/1978 | Reed | 252/551 X |
| 4,107,095 | 8/1978 | Klisch et al. | 252/551 X |
| 4,243,549 | 1/1981 | Messenger et al. | 252/357 X |
| 4,304,680 | 12/1981 | Wixon | 252/DIG. 14 |
| 4,440,665 | 4/1984 | Mather et al. . | |

OTHER PUBLICATIONS

Rogers et al.: "The Nature of the Striated Textures Encountered with . . . Liquid Crystalline Phases", J. Colloid & Interface Science, vol. 30, No. 4, pp. 500–510 (1969).

*Primary Examiner*—Richard D. Lovering
*Attorney, Agent, or Firm*—Frishauf, Holtz, Goodman & Woodward

[57] ABSTRACT

Surfactant mixtures are prepared in a fluid "G" phase of more than 50% concentration, the mixtures comprise different surfactant products selected respectively from at least two of the following classes, that is to say alkyl sulphates, alkyl ether sulphates, olefin sulphonates, alkyl benzene sulphonates, alkyl sulphosuccinates, alkyl ether sulphosuccinates, alkyl sulphosuccinamates, paraffin sulphonates, fatty carboxylates, alkyl ether carboxylates, alkyl phosphates, alkyl ether phosphates, alkyl phenol sulphates, alkyl phenyl ether sulphates, alkyl phenyl ether sulphonates, fatty ester sulphonates, fatty acid sulphonates, acyl sarcosinates and acyl taurides.

30 Claims, No Drawings

CONCENTRATED AQUEOUS SURFACTANT COMPOSITIONS

This is a continuation of application Ser. No. 967,576 filed Dec. 8, 1978 now abandoned.

The present invention relates to novel concentrated aqueous surfactant compositions, which comprise mixtures of different surfactants.

Mixtures of surfactants are prepared and sold for a wide variety of industrial and domestic applications. They are often required in a fluid form, and it is desirable that they should contain as high a proportion of active material as possible.

Where the mixture has a melting point below, or only slightly above ambient temperature it is sometimes possible to supply the composition in the form of an anhydrous mixture, or a mixture containing up to about 5% of water, respectively. In the latter case the trace of water appears to act as a melting point depressor.

However, in the case of surfactant mixtures which are solid at temperatures above about 25° C., it has often been impossible to obtain a fluid composition at concentrations above about 30 to 50% by weight of active ingredient, depending on the nature of the mixture. Small amounts of water up to about 10% do not depress the melting point sufficiently, while larger amounts, sufficient to cause a phase change result in the formation of a rigid gel, rather than a fluid solution. It has generally been found that as the total concentration of surface active ingredient in a dilute solution approaches a critical level, which is usually about 30% by weight but may in the case of some mixtures be higher, e.g. up to about 55% by weight, the viscosity of the solution begins to rise, causing difficulty in preparing and handling the solution. At the critical level the solution sets into an immobile gel, or phase separation occurs.

It is sometimes possible to increase the concentration of active ingredient by addition of viscosity modifiers or cosolvents, such as alcohols, which act as thinners, both lowering the viscosity of the solution and inhibiting the formation of gels, so that higher concentrations may be attained. Such cosolvents are normally only effective in producing substantial increases in the attainable concentration when they are present in relatively large amounts. Some solvents constitute a fire hazard at these concentration, and most adversely affect the properties of the product for many of its desired end uses and/or increase the cost of the product.

The term "active concentration" will be used hereinafter to denote the total concentration of "active" (i.e. surface active) ingredients in the solution.

It has been reported (see for example "Advances in Colloid Interface Science" 1 (1967) 79110 pp. 82–83) that some surfactant compounds are capable of forming highly viscous, non-pumpable liquid crystal phases. Some of these compounds form a phase of relatively low viscosity compared with the other liquid crystal phases, which is usually referred to as the "G" or "lameller phase" and which forms only within a specific active concentration range. However, in most instances, including the case of virtually all those compounds which are of industrial interest, where the existence of a "G" phase have been reported, it can only be formed at elevated temperatures. Thus, for example, sodium lauryl sulphate has been reported to form a "G" phase, at about 74° C., which is pourable. However, due to the elevated temperature required, these observations have hitherto been regarded as having purely academic interest. There has been no recognised industrial application of the phenomenon. Moreover it has never been reported that mixtures of different kinds of surfactant are capable of forming a "G" phase.

Recently, we have discovered that certain surfactants of commercial value including some ammonium alkyl sulphates and some olephin sulphonates form "G" phase at ambient temperature. As a consequence of this discovery we are now able to prepare these surfactants in a fluid form at very much higher active concentrations than could previously have been achieved. (See for example our copending British Patent Application No. 2038/74.)

We have now discovered that certain mixtures of surfactants form a fluid lamellar (G) phase within a narrow range of concentrations lying above the concentration at which the immobile phase forms. This range often lies above 60% active concentration and may be as high as 80%.

The mixtures tend to form fluid "G" phases at relatively low temperatures compared with the typical minimum temperatures at which aqueous solutions of most individual surfactants which are capable of forming "G" phases can exist in such a phase. Usually the mixtures can be obtained as a fluid "G" phase at ambient temperatures or by slight warming.

By preparing solutions of such mixtures at the particular concentration corresponding to the formation of the "G" phase we have been able to obtain pumpable mixtures of surfactants at active concentrations which are in some cases more than double the maximum which has hitherto been attainable. This gives rise to substantial savings in the cost of transporting and storing the products. It has also been discovered that the more highly active compositions of our invention have bacteriostatic properties.

The compositions are, generally, unexpectedly easy to dilute back to conventional dilutions, in comparison with single component surfactants, and, in many instances, show little or no tendency to form an intermediate gel phase on addition of sufficient water to effect such dilution.

The invention provides an aqueous surfactant composition comprising at least 20% and not more than 50% by weight of water and an active mixture consisting of at least 5% by weight each of surfactant products selected from at least two of the following classes, that is to say, alkyl sulphates, alkyl ether sulphates, olefin sulphonates, alkyl benzene sulphonates, alkyl sulphosuccinates, alkyl ether sulphosuccinates, alkanolamide sulphosuccinates, alkanolamide ether sulphosuccinates, alkyl sulphosuccinamates, paraffin sulphonates, fatty carboxylates, alkyl ether carboxylates, alkyl phosphates, alkyl ether phosphates, alkyl phenol sulphates, alkyl phenyl ether sulphates, alkyl phenyl ether sulphonates, fatty ester sulphonates, fatty acid sulphonates, acyl sarcosinates and acyl taurides, wherein, in each case, there are alkyl or acyl groups which have an average total of from 8 to 22 carbon atoms and any ether groups comprise glyceryl groups and/or polyoxyalkylene groups derived from the reaction of the alkanol or alkyl phenol feedstock with from 1 to 20 moles of ethylene oxide and/or propylene oxide, said mixture in the presence of water exhibiting a "G" phase at a temperature below 23° C., and the active concentration of said mixture corresponding to that at which the composition can exist, at least predominantly in the "G" phase.

The term "ether" is used herein in the normal commercial sense to denote glyceryl ethers or the polyoxyalkylene products which are usually made by the reaction of an alkanol or alkyl phenol with alkylene oxide to form an alkoxylated intermediate product which is then converted to the final anionic product. Thus, for example, the term "alkyl ether sulphate" as used herein includes the product which is usually manufactured by alkoxylating an 8 to 22 carbon atom fatty alcohol with from 1 to 20 moles of ethylene or propylene oxides, reacting the resulting intermediate product with a sulphating agent and neutralising the alkyl ether sulphuric acid so formed. The term "olefin sulphonate" is, similarly, used in its normal commercial sense to denote the product formed by sulphonating an olefin and neutralising the sulphonation product.

The "G" phase is pumpable phase which is formed over a narrow range of concentrations, which range usually lies above 45% and below 80% by weight of active ingredient and is characterised by a lamellar structure in which the surfactant molecules are associated to form plates of indefinite size separated by planes of water molecules.

Typically when a surfactant mixture having a composition corresponding to the active ingredients according to the invention is prepared in aqueous solutions of increasing active concentration, the molecules are first found to associate in spherical clusters (micelles), which with increasing active concentration become rod-like. At higher active concentrations the micelles become more crowded causing a rise in the viscosity of the solution and, in the great majority of cases, eventually lengthen to form a regular hexagonal array of cylindrical surfactant micelles in an aqueous medium (the rigid "$M_1$" liquid crystal phase). If the concentration of a surfactant in the "$M_1$" phase is progressively increased a phase change occurs to give either a hydrated solid phase, or, in the case of surfactant mixtures of this invention, to convert the $M_1$ phase progressively to a fluid "G" phase until a viscosity minimum is reached. Further increase in the active concentration of the "G" phase causes the viscosity to rise until a further phase change occurs. This may lead to the formation of either a hydrated solid or a second immobile liquid crystal phase (the $M_2$ phase) which resembles the $M_1$ phase in structure, but inverted—i.e. with water as the internal phase and the surfactant as the continuous phase.

The foregoing description is somewhat simplified. The term "hydrated solid phase" has been used broadly to include those systems which comprise suspensions of solid or immobile gel phase in one or more viscous or gel phase to provide a more or less rigid material usually having a granular appearance under a polarising microscope. No one surfactant has been found which will form all of the various liquid crystal phases, however, surprisingly, all the mixtures in the classes of surfactant specified herein we have so far examined form a fluid "G" phase, even in cases where the individual components do not form "G" phases or form then only with difficulty, e.g. at high temperatures.

In general we have found, to a good approximation, that the proportion of active mixture required to form a "G" phase can be determined from the formula:

$$(C_1/g_1)+(C_2/g_2)+\ldots(C_n/g_n)=1,$$

where $C_1 \ldots C_n$ are the concentrations of the individual active components and $g_1 \ldots g_n$ are the concentrations at which each component separately forms a "G" phase of minimum viscosity. This formula enables the concentration of the mixture corresponding to the minimum viscosity "G" phase to be estimated in a majority of cases. Where g is not known, or a component does not form a "G" phase, or the above formula is not applicable, then any "G" phase can be located very rapidly and easily, using standard laboratory equipment by making a test composition having an active concentration of say 75% (or, where appropriate, whatever concentration has been estimated on the basis of the foregoing formula) and placing a sample on a slide on the block of a heated stage microscope. Examination between crossed polarisers will reveal in which phase the sample is present. The various phases each have a characteristic appearance which is easily identified by comparison for example with the photographs of typical liquid crystal phases in the classic paper by Rosevear, JAOCS Vol. 31 p 628 (1954) or in J. Colloid and Interfacial Science VOL. 30 No. 4 page 500.

If the mixture is in an $M_1$ phase, water may be allowed to evaporate from the edges of the sample under the cover disk and any phase changes observed. If an $M_2$ phase or hydrated solid is present water may be added around the edge of the cover disks and allowed to diffuse into the composition. If no "G" phase is located in this way samples may be heated progressively on the block and the operation repeated.

Usually the composition is pumpable at concentrations within a range of ±10%, preferably ±5% e.g. ±2.5% of the minimum viscosity concentration. This range tends to be broader at more elevated temperatures. Compositions may be obtained, at the limits of the range in which one or more solid gel phase is suspended in a continuous "G" phase. Such compositions are often useful on account of their appearance and constitute a particular aspect of the invention.

Typically the compositions of the invention contain two, three or four different kinds of surfactant each in a concentration of more than 10% by weight of the composition.

The compositions of our invention may contain minor amounts of non-surfactant organic solvents, such as glycols or fatty alcohols, and of electrolytes such as sodium chloride, or sulphate. Such inclusions are often present as impurities in the surfactants or the sulphoacid, phosphoric acid, sulphuric acid or carboxylic acid feed stocks from which they are usually prepared. However, we prefer not to add appreciable amounts of solvents to the compositions of our invention. We prefer where possible to maintain the proportion of non-surfactant organic solvent below 5% by weight of the active mixture and preferably below 5% by weight of the total composition. Most preferably the proportion is less than 2% by weight of the total composition e.g. less than 1%. The presence of inorganic salts or similar non-colloidal electrolyte does not generally have the same substantial disadvantages as the presence of organic solvents, but it is nevertheless generally undesirable because it tends to raise the viscosity of the fluid "G" phase at a given active concentration. We therefore prefer, generally, that the proportion of non-colloidal electrolyte be maintained within the same limits as those stated in relation to organic solvents. However there are certain circumstances in which the presence of some electrolyte may be useful, e.g. when the melting point of the "G" phase is slightly above ambient, and an increase in the electrolyte content may depress the melting point sufficiently to obtain a pumpable "G" phase without heating. In such circumstances it may sometimes be desirable deliberately to add up to about 6% by weight of electrolyte, usually sodium chloride, or sodium sulphate.

The composition of our invention may optionally contain minor amounts, e.g. up to 5% by weight of the active mixture, of other surfactants such as non-ionic or amphoteric surfactants but are preferably substantially free from cationic surfactants.

The anionic surfactants of our invention are generally the water soluble products formed by neutralising certain sulpho-acids, sulphuric acids, phosphoric acids or carboxylic acids with a base. The base may in each case conveniently be a hydroxide or carbonate of sodium, potassium, lithium or ammonium, or an amine, such as methylamine, dimethylamine, ethylamine, diethylamine, trimethylamine, ethylene, diamine, propylamine, ethanolamine, diethanolamine or triethanolamine. Mixtures of the aforesaid bases may be used.

The acid which is neutralised may for example be an alkyl sulphuric acid, an alkyl phosphoric acid or a sulphonated olefin, alkyl benzene, paraffin, carboxylic acid or carboxylic ester, or an acylated taurine or sarcosine or a carboxylic acid. The surfactant may alternatively be a sulphosuccinate or sulphosuccinamate. In each case the surfactant has at least one long chain alkyl group, the alkyl group or groups having an average of from 8 to 22 carbon atoms total, preferably 12 to 18.

The surfactants may also contain ether groups, as for example the alkyl glyceryl sulphates, alkyl polyoxyethylene sulphates, the alkyl phenyl polyoxyethylene sulphates, the alkyl polyoxyethylene phosphates and the alkanolamide polyoxyethylene sulphosuccinates. In each case the polyoxyalkylene group is preferably either a polyoxyethylene group or a mixed oxyethylene/oxypropylene group, containing in each case an average of from 1 to 20, preferably from 2 to 10 units. A typical example is a mixture of alkyl ether sulphate with alkyl benzene sulphonate.

The compositions of our invention may be prepared by mixing the individual surfactants in the presence of the correct proportion of water to obtain the product in the "G" phase. Where all the active components form a "G" phase it is often convenient to prepare each active component separately in the "G" phase, e.g. by neutralising the appropriate acid in the presence of the calculated amount of water, and then mix the components. Where one component only forms a "G" phase at an elevated temperature, that component may be prepared and blended with the other component at appropriately elevated temperatures to ensure that both components are in a pumpable state. Where one component does not form a "G" phase, or forms it only with difficulty and the other component form; a "G" phase more readily it is often convenient to prepare the second component in the "G" phase and neutralise the acid precursor of the first component in the presence of the second, adding water at a rate sufficient to maintain the whole composition in the "G" phase. Another method which may be convenient when none of the individual components forms a "G" phase sufficiently readily, is to prepare the mixture by neutralising a mixture of the acid precursors of the individual surfactants, in the presence of sufficient water to maintain the product in the "G" phase. It is also possible to prepare the active mixture in a form other than the "G" phase and adjust the water content by evaporation from, or diffusion into the mixture. This last method is not, however, usually practicable on an industrial scale.

The invention is illustrated by the following examples.

In all cases the products of the examples were mobile "G" phases at 20° C., and were prepared by blending the components.

All percentages are on a weight:weight basis.

The following materials are referred to in the examples (the physical state quoted is that existing at 23° C.):

| | | |
|---|---|---|
| NC: | This is a mixture of straight chain primary alcohols predominantly $C_{12}$ and $C_{14}$, having a mean molecular weight of 194. | |
| ESB70: | The sodium salt of sulphated NC alcohol. | |
| (G phase) | Active matter (M.M.Wt. = 384) = | 68.9% |
| | Nonionics = | 1.6% |
| | Sulphate ion = | 0.8% |
| LX65: | The sodium salt of suphated NC alcohol. | |
| (Solid/paste) | Active matter (M.M.Wt. = 296) = | 65.4% |
| | Free fatty matter = | 1.6% |
| | Sulphate ion = | 1.1% |
| LX50: | As LX65. | |
| (Viscous paste) | Active matter (M.M.Wt. = 296) = | 49.5% |
| | Free fatty matter = | 1.2% |
| | Sulphate ion = | 0.9% |
| LQ77: | The monoethanolamine sale of sulphated NC alcohol. | |
| (G phase) | Active matter (M.M.Wt. = 335) = | 79.3% |
| | Free fatty matter = | 4.1% |
| | Sulphate ion = | 1.2% |
| AOS: | Sodium salt of sulphonated straight chain | |
| (G phase) | alpha olefin, a mixture of $C_{14}$ and $C_{16}$ | |
| | Active matter (M.M.Wt. = 314) = | 71.3% |
| | Free oil = | 3.7% |
| | Sulphate ion = | 1.3% |
| KSN70: | Sodium salt of sulphated three mole | |
| (G phase) | ethoxylate of a straight chain primary alcohol predominantly a $C_{12}$, $C_{14}$, $C_{16}$ and $C_{18}$ mixture (LI alcohol) | |
| | Active matter (M.M.Wt. = 440) = | 70.5% |
| | Nonionics = | 2.0% |
| | Sulphate ion = | 0.9% |

-continued

| | | |
|---|---|---|
| SS60 (Viscous paste) | Sodium salt of sulphonated linear alkylbenzene, predominantly $C_{12}$ alkyl. | |
| | Active matter (M.M.Wt. = 348) = | 61.5% |
| | Free oil = | 1.2% |
| | Sulphate ion = | 1.1% |
| CDE: (Mobile liquid) | Diethanolamide of coconut fatty acid at about 90% purity with the remainder being free amine, free ester, and glycerol. | |
| LX40: | As LX65. | |
| (Viscous paste) | Active matter (M.M.Wt. = 296) = | 41.9% |
| | Free fatty matter = | 1.0% |
| | Sulphate ion = | 0.7% |
| SPE: (Solid) | Sodium salt of a 50:50 mixture of mono and di phosphate ester based on a three mole ethoxylate of oleyl alcohol. | |
| | Active matter = | 81.6% |
| | Nonionics = | 5.0% |
| | Phosphate ion = | 0.8% |
| SAS60: (11 and G phase mixture) | Sodium salt of alkane sulphonate, predominantly $C_{14}$, $C_{15}$, $C_{16}$ and $C_{17}$ mixture. | |
| | Active matter (M.M.Wt. = 328) = | 60.0% |
| | Nonionics = | 0.7% |
| | Sulphate ion = | 1.9% |
| LZ90: | Sodium salt of sulphated LI alcohol. | |
| (Solid) | Active matter (M.M.Wt. = 308) = | 90.4% |
| | Free fatty matter = | 1.5% |
| | Sulphate ion = | 6.6% |
| SDOS: | Sodium dioctyl sulphosuccinate. | |
| (Liquid) | Active matter (M.M.Wt. = 444) = | 49.3% |
| | Total solids = | 57.2% |
| | Inorganics = | 1.6% |
| SDD: (Liquid) | Disodium alkylethoxy sulphosuccinate based on NC alcohol + the moles ethylene oxide. | |
| | Active matter (M.M.Wt. = 566) = | 33.9% |
| | Total solids = | 40.5% |
| | Inorganics = | 1.5% |
| MKK: (Solid/paste) | Disodium alkyl sulphosuccinamate based on tallow alcohol. | |
| | Active matter (M.M.Wt. = 503) = | 30.2% |
| | Total solids = | 35.8% |
| | Inorganics = | 0.2% |
| SGG: (Liquid) | Disodium coconut monoethanolamide ethoxy sulphosuccinate based on the two mole ethoxylate of coconut fatty acid monoethanolamide. | |
| | Active matter (M.M.Wt. = 576) = | 28.8% |
| | Total solids = | 34.3% |
| | Inorganics = | 2.0% |
| SGG/C: | As SGG. | |
| (Viscous paste) | Active matter (M.M.Wt. = 576) = | 37.6% |
| | Total solids = | 44.8% |
| | Inorganics = | 2.6% |
| DBS (White Paste) | Sodium dodecyl benzene sulphonate = | 60% |
| SLES (G phase) | Sodium lauryl alcohol triethyleneoxy sulphate = | 70% |

EXAMPLES

| Number | Mixture % | Active Concentrations % | Total active at which M1 phase is formed by dilution with water (%) |
|---|---|---|---|
| 1 | 62.2, LX65 | 40.7 | 60 |
| | 37.8, ESB70 | 26.0 | |
| | | 66.7 | |
| 2 | 79.0, ESB70 | 54.4 | 62 |
| | 21.0, LX50 | 10.4 | |
| | | 64.8 | |
| 3 | 50.0, LQ77 | 39.7 | 66 |
| | 50.0, ESB70 | 34.4 | |
| | | 74.1 | |
| 4 | 66.7, KSN70 | 47.0 | 58 |
| | 33.3, AOS | 23.7 | |
| | | 70.7 | |
| 5 | 58.8, KSN70 | 41.5 | 52 |

-continued

| Number | Mixture % | Active Concentrations % | Total active at which M1 phase is formed by dilution with water (%) |
|---|---|---|---|
| | 29.4, SS60 | 18.1 | |
| | 11.8, AOS | 8.4 | |
| | | 68.0 | |
| 6 | 48.5, LQ77 | 38.5 | 63 |
| | 48.5, ESB70 | 33.4 | |
| | 3.0, CDS | 2.7 | |
| | | 74.6 | |
| 7 | 51.5, SPE | 42.0 | 59 |
| | 48.5, LX40 | 20.3 | |
| | | 62.3 | |
| 8 | 66.6, SAS60 | 40.0 | 59 |
| | 26.7, AOS | 19.0 | |
| | 6.7, LZ90 | 6.1 | |
| | | 65.1 | |
| 9 | 90.9, SDOS | 44.8 | 45 |

-continued

| Number | Mixture % | Active Concentrations % | Total active at which M1 phase is formed by dilution with water (%) |
|---|---|---|---|
| | 9.1, LZ90 | 8.2 | |
| | | 53.0 | |
| 10 | 83.3, KSN70 | 58.7 | 61 |
| | 16.7, SDD | 5.7 | |
| | | 64.4 | |
| 11 | 83.3, ESB70 | 57.4 | 59 |
| | 16.7, MKK | 5.0 | |
| | | 62.4 | |
| 12 | 75.0, ESB70 | 51.7 | 53 |
| | 25.0, SGG | 7.2 | |
| | | 58.9 | |
| 13 | 66.5, SGG/C | 25.0 | 42 |
| | 33.5, ESB70 | 23.1 | |
| | | 48.1 | |
| 14 | 60.0, DBS | 36.0 | 44% |
| | 40.0, SLES | 28.0 | |
| | | 64.0 | |
| 15 | 55.0, DBS | 33.0 | 47% |
| | 45.0, SLES | 31.5 | |
| | | 64.5 | |
| 16 | 65.0, DBS | 39.0 | 41% |
| | 35.0, SLES | 24.5 | |
| | | 63.5 | |
| 17 | 70.0, DBS | 24.0 | 38% |
| | 25.0, SLES | 17.5 | |
| | | 59.5 | |

The following examples are of mixtures which could not readily be prepared by blending. They were prepared by neutralising a sulpho-acid precursor of one of the components in the presence of the other component.

In all cases a recycle neutralisation loop of 205 mls total capacity was employed for the preparations, comprising a continuous loop incorporating a circulation pump operating at 2.2 liters per minute, a heat exchanger, a product overflow, and a mixer into which were separately fed the second surfactant and the precursors of the first surfactant. The product was sampled when material representative of these feeds was overflowing from the neutralisation loop. (Throughout all percentages quoted are on a weight:weight basis.)

The following additional materials are referred to in these examples.

LX28:

This is an aqueous L1 phase of the sodium salt of sulphated NC at 29% concentration of active matter, containing 0.7% free fatty matter and 0.7% sodium sulphate.

KB2:

This is a two mole ethoxylate of NC.

CDE:

This is a diethanolamide of coconut fatty acid at about 90% concentration, the remainder being fee amine, free ester, and glycerol impurities.

DDB: sulphonic acid

This is based on a straight chain alkylbenzene having a mean molecular weight of 246. The sulphonic acid is at about 96% concentration containing nonionic, sulphuric acid and water impurities.

KSN70:

This is an aqueous G phase sodium salt of a sulphated three mole ethoxylate of a mixture of straight chain primary alcohols, predominantly $C_{12}$, $C_{14}$, $C_{16}$ and $C_{18}$ and having a mean molecular weight of 206. It is at 70% active matter, containing 2% nonionics and 1% sodium sulphate.

EXAMPLE 18

Into the neutralisation loop, initially full of ESB70, were fed ESB70 (8.67 g/min.), NC acid sulphate (10.0 g/min.), and a 31.5% aqueous solution of sodium hydroxide (4.82 g/min.). A pH of 7.5±0.5 was maintained by small adjustments to the sodium hydroxide feed and the temperature was held at 44° C.

The product was a mobile 'G' phase at laboratory ambient temperature and analysed as follows:

Total active matter (at a calculated mean molecular wt. of 324.5): 66.5%

Nonionics: 4.9%

Sodium sulphate: 2.4%.

(By calculation the components of the total active matter are in the ratio of 61.4:38.6, LX:ESB).

On dilution with water the product passed into the Ml(gel) phase at 60% total active matter.

In this case, cosulphation of the mixed alcohol and alcohol ethoxylate feedstocks would probably provide a suitable alternative manufacturing route.

EXAMPLE 19

Into the neutralisation loop, initially full of ESB70, were fed LX28 (6.67 g/min), KB2 acid sulphate (10.0 g/hr), and a 48.0% aqueous solution of sodium hydroxide (2.23 g/min). A pH of 7.5±0.5 was maintained by small adjustments to the sodium hydroxide feed and the temperature was held at 45° C.

The product was a mobile 'G' phase at laboratory ambient temperatures and analysed as follows:

Total active matter (at a calculated mean molecular weight of 367): 65.0%

Nonionics: 1.9%

Sodium sulphate: 0.4%.

(by calculation the components of the total active matter are in the ratio of 15.8:84.2, LX:ESB)

On dilution with water the product passed into the M1 phase at 62% active matter.

Again sulphation of the mixed feedstock would probably provide a suitable manufacturing route.

EXAMPLE 20

Into the neturalisation loop, initially full of ESB70, were fed CDE (6.23 g/min), KB2 acid sulphate (5.83 g/min), and an 11.8% aqueous solution of sodium hydroxide (5.50 g/min). The pH was maintained at 7.5±0.5 by small adjustments of the sodium hydroxide feed and the temperature was held at 42° C.

The product was a mobile G phase at laboratory ambient temperatures and analysed as follows:

Anionic active matter (M.M.Wt.=384): 34.0%

Nonionics: 36.5%

Sodium sulphate: 0.3%

(By calculation the determined nionics level is composed of 32.0% CDE active, 3.6% nonionic impurities from the CDE, and 0.9% impurities from the KB2 acid sulphate).

On dilution this material pass through a viscosity peak at 18% anionic active, at which the product was an immobile mixture of L1, M1 and G phases.

The product of this example could also be made by blending ESB70 and the liquid CDE followed by dilution with water

EXAMPLE 21

Into the neutralisation loop, initially full of KSN70, were fed KSN70 (7.33 g/min), DDB sulphonic acid (4.64 g/min), and 29.6% aqueous sodium hydroxide solution (2.05 g/min). The pH was maintained at 7.5±0.5 by small adjustments to the sodium hydroxide feed and the temperature was held at 40° C.

The product was a mobile G phase at laboratory ambient temperatures and analysed as follows:
Sulphonate active matter (MMW=348): 34.0%
Sulphate active matter (MMW=440): 36.7%
Nonionics: 1.9%
Sodium sulphate: 1.4%.

On dilution with water the material formed M1 phase at 55% total active matter.

We claim:

1. A pumpable aqueous surfactant composition consisting essentially of water, and an active surfactant mixture in an amount between above 45% and below 80% by weight and sufficient to form the "G" phase with said water, said active mixture consisting of at least 5% each by weight of the composition, of different surfactant products selected respectively from at least 2 of the classes consisting of: alkyl sulphates; alkyl ether sulphates; olefin sulphonates; alkyl benzene sulphonates; alkyl sulphosuccinates; alkanolamide sulphosuccinates; paraffin sulphonates; fatty carboxylates; alkyl ether carboxylates; alkyl phosphates; alkyl ether phosphates; alkyl phenol sulphates; alkyl phenol ether sulphates; alkyl phenol ether sulphonates; fatty ester sulphonates; fatty acid sulphonates; acyl sarcosinates; and acyl taurides; wherein, in each case, there are alkyl, alkenyl or acyl groups which have an average total of from 8 to 22 carbon atoms and any ether groups comprise glyceryl groups and/or polyoxyalkylene groups, which polyoxyalkylene groups comprise from 1 to 20 ethylene oxide and/or propylene oxide units, said aqueous surfactant composition being in the "G" phase at a temperature below 23° C.

2. A composition according to claim 1 consisting essentially of at least 60% of said active mixture.

3. A composition according to claim 2, containing up to 5% by weight of the active mixture of nonionic and/or amphoteric surfactants.

4. A composition to claim 2, having n active components where n is an integer greater than 1, and wherein the active components are each capable of forming a "G" phase with water at concentrations respectively of $g_1 \ldots g_n$ and are present in the composition respectively at concentrations of $c_1 \ldots c_n$ such that $(C_1/g_1)+(C_2/g_2)+\ldots(C_n/g_n)=1$.

5. A composition according to claim 2, wherein the graph of viscosity against the concentration of active mixture in water exhibits a minimum value corresponding to the formation of the "G" phase and wherein the proportion of active mixture present in the composition lies within ±10% of the concentration corresponding to the minimum value.

6. A composition according to claim 5 wherein the concentration of the active mixture lies within ±5% of the concentration corresponding to the minimum.

7. A composition according to claim 6, wherein the concentration of the active mixture lies within ±2.5% of the concentration corresponding to the minimum.

8. A composition according to either of claims 1 or 5, wherein at least two different components are each present in proportions of more than 10% by weight of the composition.

9. A composition according to claim 8 wherein the active mixture comprises at least 10% by weight of an alkyl sulphosuccinate and at least 10% by weight of an alkyl sulphate.

10. A composition according to either of claims 1 or 5, containing less than 5% by weight of non-surfactant organic material based on the weight of the active mixture.

11. A composition according to claim 10 containing less than 5% of non-colloidal electrolyte based on the weight of the active mixture.

12. A composition according to claim 11 wherein the active mixture comprises at least 10% by weight of an alkyl sulphosuccinate and at least 10% by weight of an alkyl sulphate.

13. A composition according to claim 11 containing less than 2% by weight of non-colloidal electrolyte based on the weight of the total composition.

14. A composition according to claim 10 wherein the active mixture comprises at least 10% by weight of an alkyl sulphosuccinate and at least 10% by weight of an alkyl sulphate.

15. A composition according to claim 10 containing less than 2% of non-surfactant organic material based on the weight of the total composition.

16. A composition according to claim 15 wherein the active mixture comprises at least 10% by weight of an alkyl sulphosuccinate and at least 10% by weight of an alkyl sulphate.

17. A composition according to claim 15 substantially free from non-surfactant organic solvent.

18. A composition according to claim 17 wherein the active mixture comprises at least 10% by weight of an alkyl sulphosuccinate and at least 10% by weight of an alkyl sulphate.

19. A composition according to either of claims 1 or 5 containing less than 5% of non-colloidal electrolyte based on the weight of the active mixture.

20. A composition according to claim 19 wherein the active mixture comprises at least 10% by weight of an alkyl sulphosuccinate and at least 10% by weight of an alkyl sulphate.

21. A composition according to either of claims 1 or 5 wherein the active mixture comprises at least 10% by weight of an alkyl ether sulphate and at least 10% by weight of an alkyl benzene sulphonate.

22. A composition according to claim 21 wherein the proportion of alkyl ether sulphate is at least 50% by weight of the active mixture.

23. A composition according to either of claims 1 or 5 wherein the active mixture comprises at least 10% by weight of an alkyl ether sulphate and at least 10% by weight of an alkyl sulphate.

24. A composition according to claim 23 wherein the proportion of alkyl ether sulphate is at least 50% by weight of the active mixture.

25. A composition according to either of claims 1 or 5 wherein the active mixture comprises at least 10% by weight of an alkyl ether sulphate and at least 10% by weight of an olefin sulphonate.

26. A composition according to claim 25 wherein the proportion of alkyl ether sulphate is at least 50% by weight of the active mixture.

27. A composition according to any one of claims 1, 4, 5, 6, 7 or 2 wherein the active mixture comprises at least 10% by weight of an alkyl sulphosuccinate and at least 10% by weight of an alkyl sulphate.

28. A composition according to either of claims 1 or 5 wherein the active mixture comprises at least 10% by weight of an alky ether sulphosuccinate and at least 10% by weight of an alkyl ether sulphate.

29. A composition according to either of claims 1 or 5 wherein the active mixture comprises at least 10% by weight of an alkyl ether sulphate and at least 10% by weight of an alkyl sulphosuccinamate.

30. A composition according to either of claims 1 or 5 wherein the active mixture comprises at least 10% by weight of an alkanolamido ether sulphosuccinate and at least 10% by weight of an alkyl ether sulphate.

* * * * *

US004692271B1

REEXAMINATION CERTIFICATE (3279th)

United States Patent [19]

[11] B1 4,692,271

Messenger et al.

[45] Certificate Issued Jul. 22, 1997

[54] CONCENTRATED AQUEOUS SURFACTANT COMPOSITIONS

[75] Inventors: Edward T. Messenger, Workington; Douglas E. Mather; Brinley M. Phillips, both of Whitehaven, all of United Kingdom

[73] Assignee: Albright & Wilson Limited, Warley, England

Reexamination Request:
No. 90/004,197, Mar. 28, 1996

Reexamination Certificate for:

| | |
|---|---|
| Patent No.: | **4,692,271** |
| Issued: | **Sep. 8, 1987** |
| Appl. No.: | **171,998** |
| Filed: | **Jul. 24, 1980** |

Related U.S. Application Data

[63] Continuation of Ser. No. 967,576, Dec. 8, 1978, abandoned.

[30] Foreign Application Priority Data

Dec. 9, 1977 [GB] United Kingdom ..... 51293/77

[51] Int. Cl.[6] ..... B01F 17/02; B01F 17/10; B01F 17/12

[52] U.S. Cl. ..... 252/354; 252/353; 252/355; 510/427; 510/428; 510/429; 510/417; 510/431

[58] Field of Search ..... 252/353, 354, 252/355; 510/427, 428, 429

[56] References Cited

U.S. PATENT DOCUMENTS

| | | | |
|---|---|---|---|
| B 283,300 | 1/1975 | Boehmke | 252/354 X |
| 2,052,027 | 8/1936 | Harris | 252/355 X |
| 2,256,877 | 9/1941 | Bertsch | 252/355 X |
| 2,671,797 | 3/1954 | Hagemann et al. | 558/39 |
| 2,781,356 | 2/1957 | Mannheimer | 252/357 X |
| 3,413,331 | 11/1968 | Beiser et al. | 558/34 |
| 3,574,125 | 4/1971 | van Paassen | 252/551 |
| 3,793,233 | 2/1974 | Rose et al. | 510/429 |
| 3,867,316 | 2/1975 | Frank et al. | 252/545 |
| 3,912,662 | 10/1975 | Martinsson et al. | 510/422 |
| 3,919,125 | 11/1975 | Ashina et al. | 252/551 |
| 3,954,660 | 5/1976 | Kennedy et al. | 252/353 |
| 3,954,845 | 5/1976 | Martinsson et al. | 510/466 |
| 3,962,149 | 6/1976 | Chirash et al. | 510/283 |
| 3,985,687 | 10/1976 | Inamorato et al. | 510/325 |
| 4,029,624 | 6/1977 | Burkhard et al. | 252/354 X |
| 4,061,602 | 12/1977 | Oberstar et al. | 510/121 |
| 4,088,612 | 5/1978 | Carter et al. | 510/428 |
| 4,191,704 | 3/1980 | Mather et al. | 558/38 |

FOREIGN PATENT DOCUMENTS

| | | |
|---|---|---|
| 1017217 | 9/1977 | Canada . |
| 0 079 646 | 5/1983 | European Pat. Off. . |
| 2 242 458 | 3/1975 | France . |
| 19 16 283 | 10/1970 | Germany . |
| 23 41 592 | 2/1975 | Germany . |
| 27 11 434 | 10/1977 | Germany . |
| 50-85607 | 7/1975 | Japan . |
| 921 036 | 3/1963 | United Kingdom . |
| 995 353 | 6/1965 | United Kingdom . |
| 1 027 800 | 4/1966 | United Kingdom . |
| 1 065 460 | 4/1967 | United Kingdom . |
| 1 073 761 | 6/1967 | United Kingdom . |
| 1 073 762 | 6/1967 | United Kingdom . |
| 1 084 739 | 9/1967 | United Kingdom . |
| 1 114 359 | 5/1968 | United Kingdom . |
| 1 164 854 | 9/1969 | United Kingdom . |
| 1 194 745 | 6/1970 | United Kingdom . |
| 1 205 711 | 9/1970 | United Kingdom . |
| 1 229 134 | 4/1971 | United Kingdom . |
| 1 341 937 | 12/1973 | United Kingdom . |
| 1 410 784 | 10/1975 | United Kingdom . |
| 1 449 821 | 9/1976 | United Kingdom . |
| 1 547 361 | 6/1979 | United Kingdom . |
| 1 553 123 | 9/1979 | United Kingdom . |
| 1 559 823 | 1/1980 | United Kingdom . |

OTHER PUBLICATIONS

Krusche et al., (1975), "Determination of the Non–Ethoxylated Alcohol in Ethoxylates," *Tenside Detergents*, vol. 1, No. 12 pp. 35–38.

Weimer et al., (1966) "Component Distribution of Alcohol Ethylene Oxide Adducts," *The Journal of The American Oil Chemists' Society*, vol. 43 pp. 440–445.

*J. Soc. Cosmetic Chemists*, 19, pp. 581–594 (1968).

Jones and Turner, (Shell Research Ltd.), 5th Int. Cong. Surf. Act. B III (54); (1968).

Rogers and Winsor (Shell Research Ltd.), *J. Coll. Interfac. Sci*, 30 (4) 500 (1969).

Luzzati (Centre De Genetique Moleculaire. C.N.R.S. France, "Biological Membranes," Chapman D (ed) Acad. Press 1968, Chapt. 3.

Skaulios, A. (Centre de Recherches sur les Macromolecules Strasbourg), *Adv. Colloid Interface Sci*, 1, 79–110 (1967).

Tiddy G.J.T. (Unilever Research, Port Sunlight) J.C.S. Farad Trans. 1 4, 653 (1972).

Rosevear F.B. (Procter and Gamble Co. Cincinnati). J.A.O.C.S. 31 628 (1954).

Vold M. (Stanford University) *J.A.C.S.* 63, 1427–32 (1941).

Hatshorne and Stuart (Universities of Leeds and Exeter), "Crystals and the Polarising Microscope", 4th Ed. Arnold 1970, Ch. 14.

Winsor, P.A. (Shell Research Ltd.), Molecular Crystals and Liquid Crystals 12 141–78 (1971).

Clunie, Goodman & Corkill (P&G, Basic Research, Newcastle). Proc. Roy. Soc. A 285 520–533 (1965).

(List continued on next page.)

*Primary Examiner*—Richard D. Lovering

[57] ABSTRACT

Surfactant mixtures are prepared in a fluid "G" phase of more than 50% concentration, the mixtures comprise different surfactant products selected respectively from at least two of the following classes, that is to say alkyl sulphates, alkyl ether sulphates, olefin sulphonates, alkyl benzene sulphonates, alkyl sulphosuccinates, alkyl ether sulphosuccinates, alkyl sulphosuccinamates, paraffin sulphonates, fatty carboxylates, alkyl ether carboxylates, alkyl phosphates, alkyl ether phosphates, alkyl phenol sulphates, alkyl phenyl ether sulphates, alkyl phenyl ether sulphonates, fatty ester sulphonates, fatty acid sulphonates, acyl sarcosinates and acyl taurides.

OTHER PUBLICATIONS

Brown & Shaw (Univ. of Cincinnati), *Chem. Rev.*, 54 1049 (1957).

Flautt & Lawson (P& G Cincinnati), Advances in Chemistry Series 63, *Am. Chem. Soc.* (1967).

Gray and Winsor. (Univ. of Hull and Shell Research resp.), Liquid Crystals and Plastic Crystals, Preparation Constitution and Applications, Ellis Horwood, (1974).

Goodman and Clunie (P&G Newcastle), Liquid Crystals and Plastic Crystals, vol. 2, Ch. 1; (1974).

Winsor P.A. (Shell Research Ltd.) *Chem. Rev.*, 68 (1) 1 (1968).

Ekwall, Mandell & Fontell (Royal Swedish Academy of Engineering Sciences. Stockholm)., *Molecular Crystals and Liquid Crystals*, 8, 157–213 (1969).

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 8, 9, 12, 14, 16, 18 and 20–30 are determined to be patentable as amended.

Claims 2–7, 10, 11, 13, 15, 17 and 19, dependent on an amended claim, are determined to be patentable.

1. A pumpable aqueous surfactant composition consisting essentially of water, and an active surfactant mixture in an amount between above 45% and below 80% by weight and sufficient to form the "G" phase with said water, said active mixture consisting of at least 5% each by weight of the composition, of different surfactant products selected respectively from at least 2 of the classes consisting of: alkyl sulphates; alkyl ether [sulphates] *sulphate products produced by alkoxylating an 8 to 22 carbon atom fatty alcohol with 1 to 20 moles of ethylene or propylene oxides, reacting the resulting product with a sulphating agent and neutralizing the alkyl sulphuric acid so formed*; olefin sulphonates; alkyl benzene sulphonates; alkyl sulphosuccinates; alkanolamide sulphosuccinates; paraffin sulphonates; fatty carboxylates; alkyl ether carboxylates; alkyl phosphates; alkyl ether phosphates; alkyl phenol sulphates; alkyl phenol ether sulphates; alkyl phenol ether sulphonates; fatty ester sulphonates; fatty acid sulphonates; acyl sarcosinates; and acyl taurides; wherein, in each case, there are alkyl, alkenyl or acyl groups which have an average total of from 8 to 22 carbon atoms and any ether groups comprise glyceryl groups and/or polyoxyalkylene groups, which polyoxyalkylene groups comprise from 1 to 20 ethylene oxide and/or propylene oxide units, said aqueous surfactant composition being in the "G" phase at a temperature below 23° C.

8. A composition according to either of claims 1 or 5, wherein at least two [different components] *surfactant products* are each present in proportions of more than 10% by weight of the composition.

9. A composition according to claim 8 wherein the active mixture comprises at least 10% by weight of [an] alkyl [sulphosuccinate] *sulphosuccinates* and at least 10% by weight of [an] alkyl [sulphate] *sulphates*.

12. A composition according to claim 11 wherein the active mixture comprises at least 10% by weight of [an] alkyl [sulphosuccinate] *sulphosuccinates* and at least 10% by weight of [an] alkyl [sulphate] *sulphates*.

14. A composition according to claim 10 wherein the active mixture comprises at least 10% by weight of [an] alkyl [sulphosuccinate] *sulphosuccinates* and at least 10% by weight of [an] alkyl [sulphate] *sulphates*.

16. A composition according to claim 15 wherein the active mixture comprises at least 10% by weight of [an] alkyl [sulphosuccinate] *sulphosuccinates* and at least 10% by weight of [an] alkyl [sulphate] *sulphates*.

18. A composition according to claim 17 wherein the active mixture comprises at least 10% by weight of [an] alkyl [sulphosuccinate] *sulphosuccinates* and at least 10% by weight of [an] alkyl [sulphate] *sulphates*.

20. A composition according to claim 19 wherein the active mixture comprises at least 10% by weight of [an] alkyl [sulphosuccinate] *sulphosuccinates* and at least 10% by weight of [an] alkyl [sulphate] *sulphates*.

21. A composition according to either of claims 1 or 5 wherein the active mixture comprises at least 10% by weight of [an] *said* alkyl ether sulphate *products* and at least 10% by weight of [an] alkyl benzene [sulphonate] *sulphonates*.

22. A composition according to claim 21 wherein the proportion of *said* alkyl ether sulphate *products* is at least 50% by weight of the active mixture.

23. A composition according to either of claims 1 or 5 wherein the active mixture comprises at least 10% by weight of [an] *said* alkyl ether sulphate *products* and at least 10% by weight of [an] alkyl [sulphate] *sulphates*.

24. A compositon according to claim 23 wherein the proportion of alkyl ether sulphate *products* is at least 50% by weight of the active mixture.

25. A composition according to either of claims 1 or 5 wherein the active mixture comprises at least 10% by weight of [an] *said* alkyl ether sulphate *products* and at least 10% by weight of [an] olefin [sulphonate] *sulphonates*.

26. A composition according to claim 25 wherein the proportion of alkyl ether sulphate *products* is at least 50% by weight of the active mixture.

27. A composition according to any one of claims 1, 4, 5, 6, 7 or 2 wherein the active mixture comprises at least 10% by weight of [an] alkyl [sulphosuccinate] *sulphosuccinates* and at least 10% by weight of [an] alkyl [sulphate] *sulphates*.

28. A composition according to either of claims 1 or 5 wherein the active mixture comprises at least 10% by weight of [an] alkyl ether [sulphosuccinate] *sulphosuccinates* and at least 10% by weight of [an] *said* alkyl ether sulphate *products*.

29. A composition according to either of claims 1 or 5 wherein the active mixture comprises at least 10% by weight of [an] *said* alkyl ether sulphate *products* and at least 10% by weight of [an] alkyl [sulphosuccinamate] *sulphosuccinate*.

30. A composition according to either of claims 1 or 5 wherein the active mixture comprises at least 10% by weight of [an] alkanolamido ether [sulphosuccinate] *sulphosuccinates* and at least 10% by weight of [an] *said* alkyl ether sulphate *products*.

* * * * *